US005101329A

United States Patent [19]

Doyle

[11] Patent Number: 5,101,329

[45] Date of Patent: Mar. 31, 1992

[54] REALTY SIGN LIGHTING AND DISPLAY ASSEMBLY

[76] Inventor: Kenneth Doyle, 8542 Mammoth Ave., Panorama City, Calif. 91402

[21] Appl. No.: 466,106

[22] Filed: Jan. 16, 1990

[51] Int. Cl.[5] ..... F21L 13/00

[52] U.S. Cl. ..... 362/183; 362/191; 362/431; 362/812; 362/802; 40/563

[58] Field of Search ..... 362/191, 217, 221, 183, 362/253, 260, 276, 295, 368, 394, 396, 431, 812, 802; 40/563, 607

[56] References Cited

U.S. PATENT DOCUMENTS

| | | | |
|---|---|---|---|
| 4,319,310 | 3/1982 | Kingsley | 362/183 |
| 4,384,317 | 5/1983 | Stackpole | 362/183 |
| 4,410,930 | 10/1983 | Yachabach | 362/145 |
| 4,441,143 | 4/1984 | Richardson, Jr. | 362/183 |
| 4,481,562 | 11/1984 | Hickson | 362/183 |
| 4,484,104 | 11/1984 | O'Brien | 362/812 X |
| 4,590,543 | 5/1986 | Chen | 362/183 |
| 4,718,185 | 1/1988 | Conlin et al. | 362/183 X |
| 4,835,664 | 5/1989 | Wen | 362/183 |

*Primary Examiner*—Stephen F. Husar
*Attorney, Agent, or Firm*—John J. Posta, Jr.

[57] ABSTRACT

The realty sign lighting and display assembly includes a generally inverted U-shaped housing which fits over the horizontal arm of a realty sign, a lock releasably holding the bracket to the arm, with or without springs spacing the bracket from the arm. The solar panel is connected to a storage battery, in turn connected to lights, all borne by the light assembly which also carries a light-responsive switch and timer so that the lights operate only at a suitable low light level. The assembly can be provided in kit form or fully connected together, is light in weight and is fully portable and efficient.

12 Claims, 2 Drawing Sheets

REALTY SIGN LIGHTING AND DISPLAY ASSEMBLY

BACKGROUND OF THE INVENTION

1. Field of the Invention

The present invention generally relates to lighting and display devices and more particularly to a realty sign lighting and display assembly.

2. Prior Art

It is important in the selling and renting of realty that proper advertising be strategically placed adjacent the property to be rented or sold. In many cases it becomes difficult to light such signs at night, because of an absence of a convenient close by power source. Although solar panels have in a few instances been relied on as a source of lighting power for such devices and structures as outdoor phone booths and the like, such assemblies are usually of the permanent type, portability not being contemplated. In the case of realty signs, however, portability is essential, since such signs are moved around from one house or building to the next as they are each in turn rented or sold.

Such signs are most effective when they are lighted at night, since many people drive by at night to look at residences and business property they are interested in, evening hours being convenient for the prospective purchasers and buyers. Such properties are easy to locate with lighted signs, which also help to attract the attention of casual drivers by.

There remains a need for a convenient portable detachable lighting and advertising display assembly for a realty sign which provides its own source of lighting, is light in weight and easy to install and remove from a realty sign and which provides additional advertising space. Such a device should be inexpensive, durable and efficient as well as attractive.

SUMMARY OF THE INVENTION

The realty sign lighting and display assembly of the present invention satisfies all the foregoing needs. The assembly is substantially as set forth in the Abstract of the Disclosure.

Thus, the assembly comprises a generally inverted U-shaped bracket adapted to releasably fit over the horizontal arm of a realty sign and to be releasably attached thereto by a locking device. A storage battery, a light-activated switch and a timer are electrically connected to fluorescent or incandescent lights on the bracket. The battery is electrically connected to the solar panel and is powered by it. The usual current conversion components may also be present, if needed, in the assembly to enable the battery power to operate the lights.

With the described assembly, the sign to which the assembly is releasably attached can be lighted at night, with the lights switched off automatically when the sun appears and automatically switched on when the sun sets. It can have a timer circuit which can be set for 2–6 hours. The assembly is inexpensive, durable, light in weight, easy to move around from one display sign to another and requires no external power source.

Various other advantages of the realty sign lighting and display assembly of the present invention are set forth in the following detailed description and the accompanying drawings.

DRAWINGS

FIG. 1 is a schematic side perspective view of a preferred embodiment of the realty sign lighting and display assembly of the present invention releasably secured over the horizontal arm of a realty sign; and, FIG. 2 is a sectional side elevation of the solar panel and connector portion of the improved assembly of FIG. 1, taken along lines A—A of FIG. 1, FIG. 3 is a side perspective view of another embodiment of the invention, showing a single fluorescent light.

DETAILED DESCRIPTION

Figure 1:
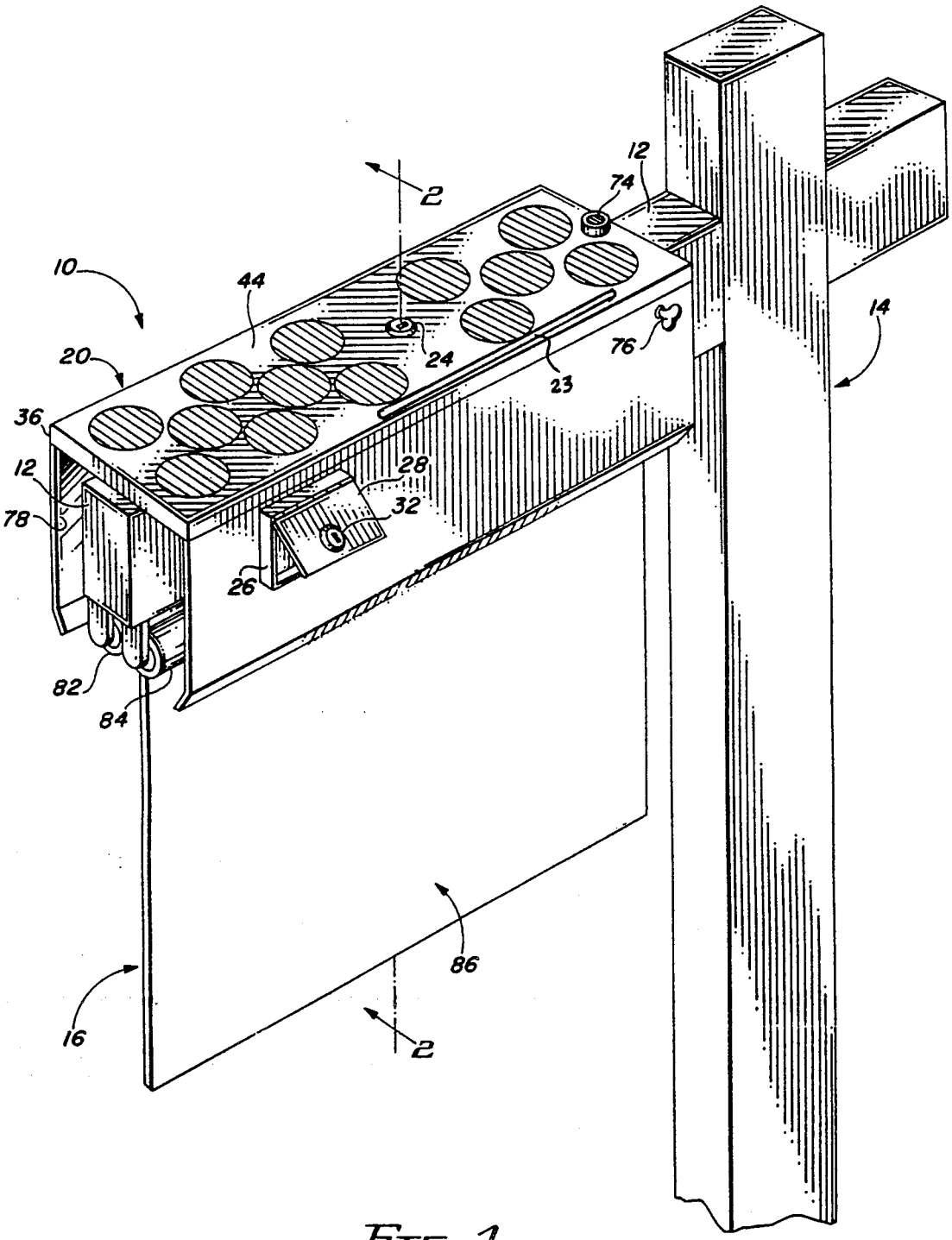
Figure 2:
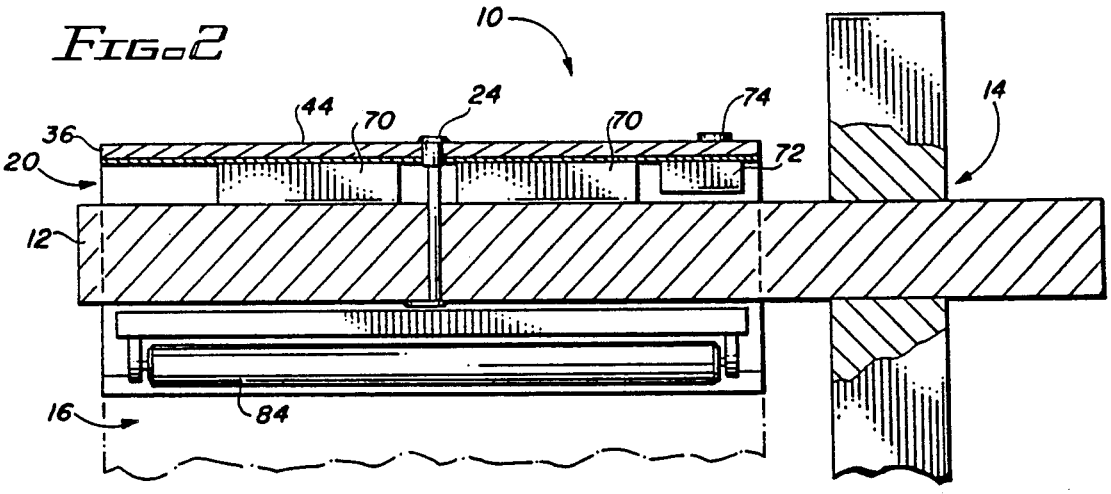

FIGS. 1 and 2

Now referring more particularly to the accompanying drawings, FIG. 1 shows a schematic view of a preferred embodiment of the improved assembly of the present invention. Thus, assembly 10 is shown, releasably secured over the horizontal arm 12 of a realty sign post 14. Arm 12 also bears a depending broker panel 16 suspended therefrom by a hook and ring connector assembly 18 (not illustrated).

Assembly 10 comprises a housing 20 which is generally inverted U-shaped and which bears all the other components of assembly 10. Housing 20 may be of wood, metal, plastic, ceramic or the like and can be of different size and configuration than that shown so long as it fits over arm 12. Housing 20 is releasably spaced from the side margins of arm 12 and is releasably locked to side arm 12 by a lock 24 which is spring biased and in the locked position passes into the side or top of arm 12 through the side bracket 20. FIG. 1 shows lock 24 in the unlocked position. Lock box 26 has a hinged lid 28 shown in the up position and releasably locked by an integral key lock 32. Other means of locking lock 24 from ready access are also possible, as are other means of locking box 26.

Solar panel 44 sits on top surface 36. Bracket 20 also includes a battery 70 electrically connected to solar panel 44, with a built-in programmable timer 72 of conventional type and with a light-activatable switch 74 (or a potentiometer). Timer 72 can be set by a key 76. Battery 70 is electrically connected to one or two fluorescent bulbs which are used to illuminate indicia 86 on panel 16. Bulbs 82 and 84 are positioned so as to be protected against the elements by solar panel 44 and bracket 20. Light is reflected down to illuminate realty sign 16 by reflective surface 78.

As can be seen from FIGS. 1 and 2, assembly 10 is very compact and light in weight, employing conventional components in a unique combination. Assembly 10 can be separated from horizontal arm 12 of realty sign 14 merely by unlocking lock box 26, or in case of a vertical lock, unlocking lock 24 and then lifting bracket 20 up and away from arm 12. If desired, a slot 23 can be provided in bracket 20 to retain an agent or broker's sign.

Light assembly 20 can be removed from sign and transported.

FIG. 3

Figure 3:
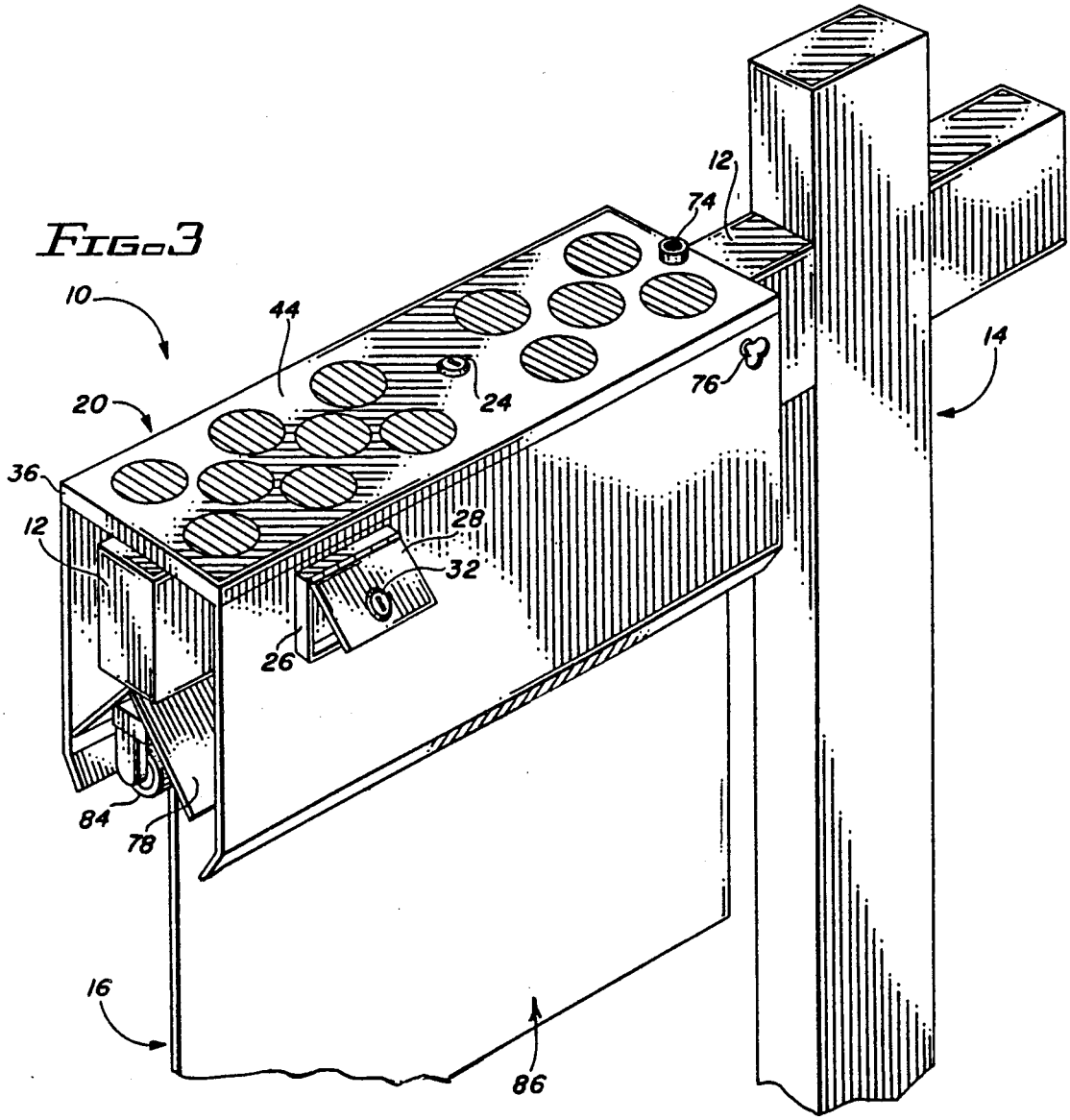

Another embodiment of the invention is shown in FIG. 3. The elements of FIG. 3 which are identical to the elements of FIG. 1 have the same numerals, but have an "a" added. The only difference between FIG. 3 and FIG. 1 is the substitution of a single bulb 85*a* and reflector 79*a* of FIG. 3 for the pair of bulbs 82, 84 and reflector 78 of FIG. 1, which results in a less complicated and less costly device.

Various other advantages, features and points of interest in the assembly of the present invention are as set forth in the foregoing. Various modifications, changes, alterations and additions can be made in the improved assembly of the present invention, its components and parameters. All such modifications, changes, alterations and additions as are within the scope of the appended claims form part of the present invention.

What is claimed is:

1. A realty sign lighting and display assembly including:

a) a real estate standard having a vertical post and a horizontal arm, b) a housing, including a bracket;

c) means releasably securing the housing to said arm;

d) a solar panel incorporated in said housing;

e) a rechargeable battery connected to said solar panel; and, f) at least one light connected to said bracket and battery.

2. The display assembly of claim 1, including switch and timer means connected to said lights.

3. The display assembly of claim 1 wherein said housing is inverted U-shaped and fits over the horizontal arm of said sign.

4. The display assembly of claim 1, including an agent or broker panel which can fit into a slot in the top surface of said bracket, and wherein said lights are powered solely by rechargeable batteries.

5. The display assembly of claim 4 wherein said switch means include a light-responsive switch and a programmable timer.

6. The display assembly of claim 5 wherein said releasable securing means include a lock extending transversely through said bracket into said arm, horizontally or vertically.

7. The display assembly of claim 6 wherein said assembly includes a broker panel depending from said arm.

8. A realty sign lighting and display assembly, including:

a) a real estate standard having a vertical post and a horizontal arm;

b) a housing including a bracket releasably fitted over said arm of a realty sign;

c) means for releasably securing said bracket to said sign arm;

d) a solar panel secured to said bracket;

e) at least one rechargeable battery electrically connected to said solar panel;

f) at least one light electrically connected to to said housing and said batteries for operation thereby;

g) switch and timer means connected to said batteries and said lights for regulating the on and off periods for said light to illuminate said sign; and h) wherein said housing is inverted U-shaped and fits over said arm.

9. A realty sign lighting and display assembly, including:

a) a real estate standard having a vertical post and a horizontal arm;

b) a housing including a bracket releasably fitted over said arm of a realty sign;

c) means for releasably securing said bracket to said sign arm;

d) a solar panel secured to said bracket;

e) at least one rechargeable battery electrically connected to said solar panel;

f) at least one light electrically connected to said housing and said batteries for operation thereby; and, g) switch and timer means connected to said batteries and said lights for regulating the on and off periods for said lights to illuminate said sign.

10. The assembly of claim 9, including a slot in the top surface of said bracket for securing an agent or broker display panel, and wherein said lights are solely powered by rechargeable batteries.

11. The assembly of claim 10 wherein said switch means include a light-responsive switch and a programmable timer.

12. The improved assembly of claim 11 wherein said releasable securing means include a lock extending transversely through said bracket into said arm, horizontally and vertically.

* * * * *